US007974432B1

(12) United States Patent
Ryan

(10) Patent No.: US 7,974,432 B1
(45) Date of Patent: Jul. 5, 2011

(54) CAP FOR RETAINING AN AUDIO SYSTEM

(76) Inventor: Patrick T. Ryan, Endicott, NY (US)

( * ) Notice: Subject to any disclaimer, the term of this patent is extended or adjusted under 35 U.S.C. 154(b) by 987 days.

(21) Appl. No.: 11/894,536

(22) Filed: Aug. 21, 2007

(51) Int. Cl.
*H04R 1/02* (2006.01)

(52) U.S. Cl. ..... 381/388; 381/376; 2/195.1; 2/209.13

(58) Field of Classification Search ..... 381/388, 381/376; 2/195.1, 209.13
See application file for complete search history.

(56) References Cited

U.S. PATENT DOCUMENTS 5,438,698 A 8/1995 Burton et al.
5,625,903 A 5/1997 Schultz et al.
5,724,678 A * 3/1998 McCallum et al. ..... 2/209.13
5,881,160 A 3/1999 Sheppard
6,305,026 B1 10/2001 Mo
7,044,615 B2 5/2006 Gesten
7,519,192 B1 * 4/2009 Laycock et al. ..... 381/301
2006/0185062 A1 * 8/2006 Peng et al. ..... 2/209.13
2006/0251283 A1 * 11/2006 Yeh ..... 381/388
2007/0226876 A1 * 10/2007 Foust et al. ..... 2/171
2008/0144872 A1 * 6/2008 Phillips ..... 381/301

* cited by examiner

*Primary Examiner* — Mark Prenty
(74) *Attorney, Agent, or Firm* — Mark Levy; Hinman, Howard & Kattell

(57) ABSTRACT

A baseball styled cap that retains an elasticized sleeve on the inside, front wall of the cap. A portable audio player or radio can be inserted into the sleeve and connected to a pre-installed wiring and speaker system that is integrated into the fabric seams of the cap. This unitary configuration allows the cap with audio system to be worn and used in comfort, with little or no limitation on the physical activity of the wearer.

20 Claims, 7 Drawing Sheets

CAP FOR RETAINING AN AUDIO SYSTEM

FIELD OF THE INVENTION

The invention relates generally to hats and caps and, more particularly, to hats and caps designed to retain an audio system.

BACKGROUND OF THE INVENTION

Portable radios and music players with miniature speakers are widely distributed among the U.S. consumer public. These devices are especially popular with sports enthusiasts, who often carry them when they exercise or attend sports events. They are also commonly used by persons who engage in repetitive work, as they provide an entertaining distraction from what would otherwise be a boring routine, whether at the workplace or at home.

The popularity of portable audio devices has increased markedly with the advent of digital technology, which has allowed them to become ever smaller and lighter; today, some are scarcely more than an ounce in weight and have a surface area that is smaller than a credit card. The companion speakers, which can be inserted directly into the ears, are scarcely larger than pencil erasers. Among these audio devices are ones known to the public by the trade names MP3, NANO and iPod.

A number of prior inventions attempt to integrate these types of devices with articles of clothing, particularly hats, caps and other forms of head gear, with the intent of allowing a person to use an audio device while engaged in exercising, working, commuting or other activities. Moreover, stealing audio devices has become a significant problem, due to the fact that such devices tend to be very small and easily removed. In fact, the term for such theft is "i-jacking."

As example, U.S. Pat. No. 7,044,615 to Gesten for AUDIO ASSEMBLY AND CONNECTION SYSTEM FOR HATS shows a container apparatus attached to the visor of a standard baseball cap. The container is sized to accept a small radio or audio player, with a secondary compartment for keys, money or other small items. While this design might have some utility for joining an audio device to a cap, any vigorous activity, or even brisk walking, would tend to tilt the cap forward because of the load factor on the cap's visor. For this reason, the Gesten apparatus is not desirable for normally active persons.

A number of patents show a head band styled garment fabricated to retain an audio device or apparatus. For example, U.S. Pat. No. 5,625,903 to Schultz et al. for HEADBAND WITH ADJUSTABLE SPEAKER SUPPORTING MEANS discloses a wearable band which encircles the head in a belt like manner. The band retains two compartments which register with the ears of the user. Audio speakers can be inserted in these compartments, with their respective wires threaded out the rear portion of the head band to a separate audio playing device, which is carried in a jacket or other garment pocket, or in the hands of the user.

In a similar design, U.S. Pat. No. 5,438,698 to Burton et al. for WEARABLE AUDIO RECEPTION DEVICE shows a head band garment which has attachment means for securing an audio playing device directly to the rear portion of the head band. This apparatus does not cover or in any way register with the ears of the user. Rather, it allows the wearer to utilize standard speaker components which insert into the ears, with their respective connecting wires freely suspended and attached to the audio player.

The above patents have the disadvantage of being too warm for some wearers to use comfortably in mild weather. Additionally, they provide none of the sun shade benefits which are provided by caps or hats with visors.

U.S. Pat. No. 6,305,026 to Mo for CAP WITH HEADPHONES ASSEMBLY shows a cap with headphone assembly, whereby the headphones are attached to pivotal arms which are secured to opposing sides of the cap. The headphones can thus be swiveled downward to cover the ears of the user, or swiveled upward when not in use. A first headphone retains a radio, which is electrically connected to speakers in each of the headphones. The chief disadvantage of this device is the fact that it is aesthetically conspicuous and ungainly, with the headphones appearing and performing substantially as ear muffs, albeit ear muffs with sound. Also, the pivotal apparatus renders the cap too heavy and awkward for vigorous sports activity.

U.S. Pat. No. 5,881,160 to Sheppard for CAP WITH AUDIO SYSTEM discloses a cap with opposing tabs extending downward in proximity to the user's ears. A fabric pocket on the inside of the cap allows the placement of an audio player, with speakers attached to the aforementioned tabs. Designed for use while the wearer is at rest or asleep, this device has little utility for persons participating in sports, exercise or even light physical activity like walking.

All of the above patents combine audio apparatus with caps or headbands, but each combines the components in a way that is either cumbersome, impractical, visually ungainly or some combination thereof. As will be shown, the invention described herein avoids these limitations by providing a hat and audio system that are integrated in a manner that is stylistically discreet, as well as functionally and ergonomically efficient.

What is needed is a garment for carrying portable, miniature radios and music players that is both comfortable and inconspicuous. Moreover, the garment should be easily used, so that the wearer may insert and remove the earphones in a short time without becoming entangled in wires.

SUMMARY OF THE INVENTION

The invention provides a baseball styled cap that is fitted with an inside sleeve which nests against the front wall of the cap. The sleeve comprises an elasticized fabric, and is proportioned to accept a variety of commonly used, portable audio players or radios.

The cap is pre-wired with a speaker assembly comprising two earplug speakers and a connector plug which inserts into the audio player/receiver device. The cap has an inside cuff which extends along the length of the inside rim. This cuff creates a narrow channel in which to thread the wires of the speaker assembly. It also allows the wires to be discreetly contained, so that the only portions visible are short lengths, one each for the two earplug speakers.

The elasticized sleeve is positioned directly above the inside rim of the cap. This position allows it to occupy the void space that exists between the cap's lower rim—which rests on the forehead just above the eyebrows of the user—and the top front portion of the cap. Though small, this void space is sufficient to accommodate a late generation, miniature digital audio player or radio. This positioning, and the placement of wiring in the fabric seams of the cap, allow the entire audio system to be worn and used in comfort, with little or no limitation on the physical activity of the wearer. Moreover, the hat or cap earplugs can be inserted into and removed from the user's ears easily and even unobtrusively.

As will be seen in greater detail, no other invention disclosed or yet discovered combines the above cited advantages of style, comfort and operational performance in one unitary system.

BRIEF DESCRIPTION OF THE DRAWINGS

A complete understanding of the present invention may be obtained by reference to the accompanying drawings, when considered in conjunction with the subsequent, detailed description, in which.

Like components or process steps have identical reference numbers throughout the figures.

DETAILED DESCRIPTION OF THE PREFERRED EMBODIMENT

Figure 1:
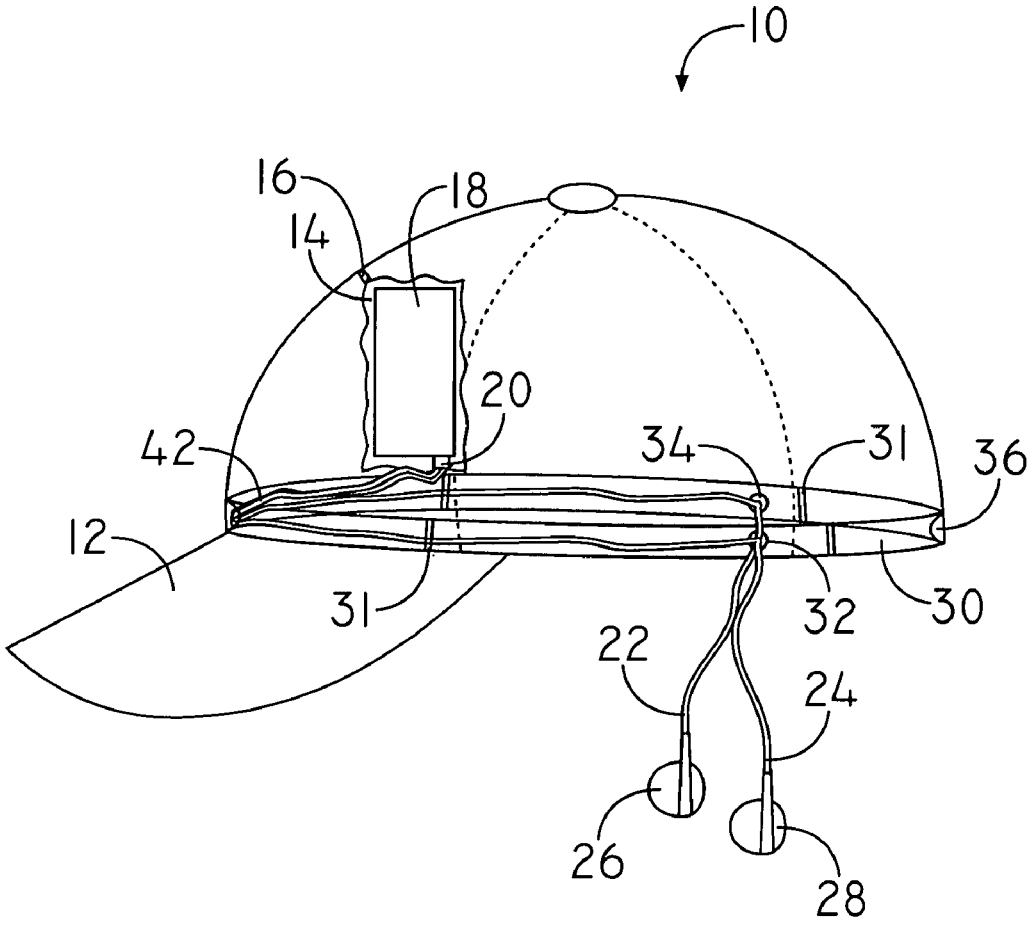
FIG. 1 is a cut-away side view of the invention showing basic components.

Referring now to FIGS. 1 through 4*b*, the invention is shown to comprise a cap 10 such as a baseball cap in the preferred embodiment, having a visor 12. Of course, other types of hats or caps can be used with the invention. A sleeve 14 is attached to the inside of cap 10 by means of a fastener 16 well known to those of skill in the art. Audio device 18 inserts into sleeve 14, which has an elasticized fabric that gathers securely around an audio device 18, such as a miniature radio or music player (e.g., iPod, MP3 player, etc.). It should be understood that, in addition to elasticized fabric, cotton, wool, synthetic blends, nylon, fleece, corduroy, or denim can be used.

Connector plug 20 inserts into audio device 18. Connector plug 20 is attached to a dual wire 42, which splits to form speaker wires 22 and 24. Speaker wires 22 and 24 are threaded through holes 32 and 34, respectively, in a cuff 30, and then extend to their respective terminations at speakers or earphones or buds 26 and 28.

Figure 2A:
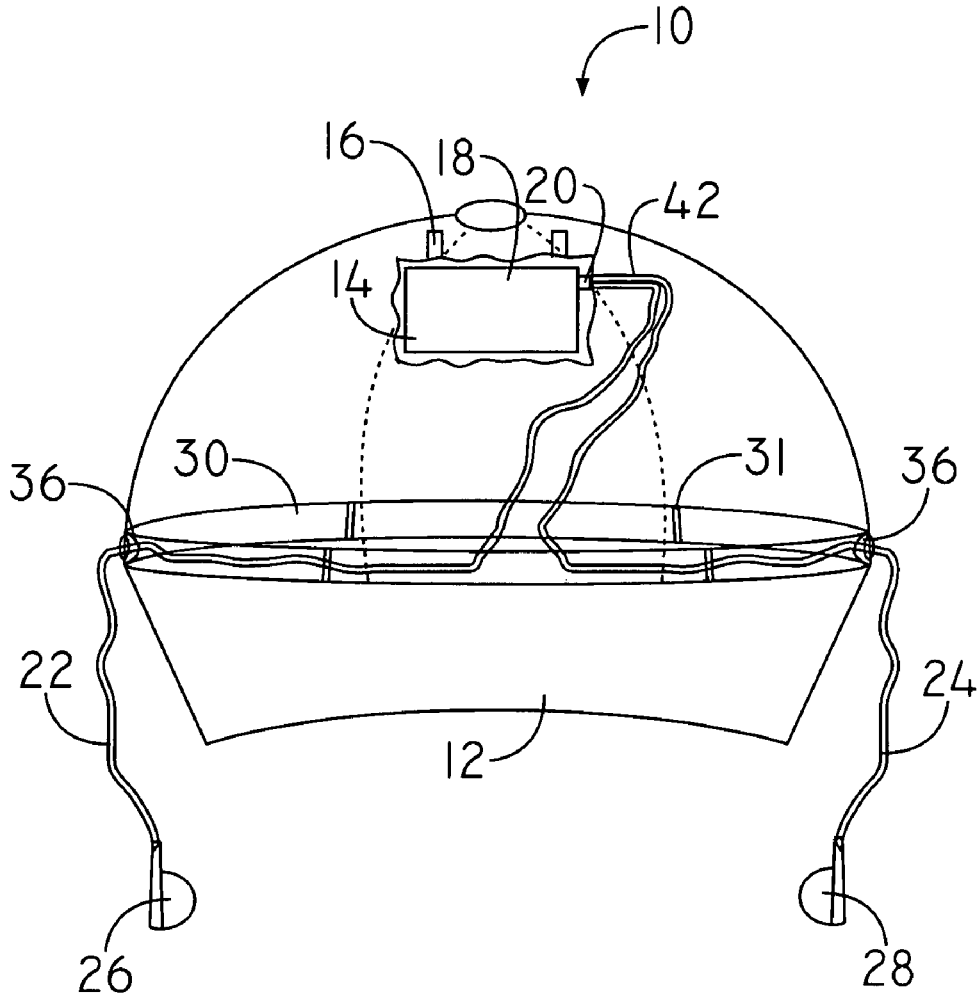
FIG. 2*a* is a cut-away front view of the invention.
Figure 2B:
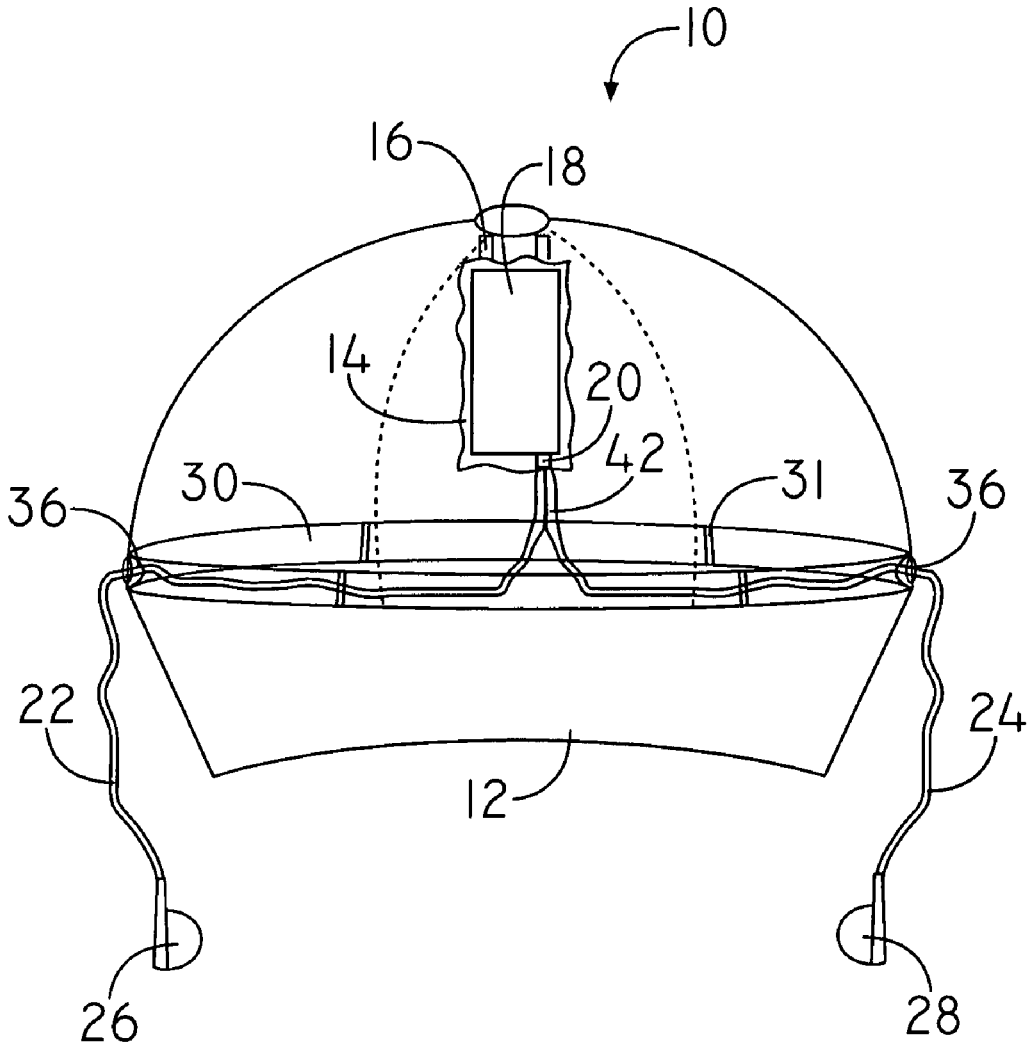
FIG. 2*b* is a cut-away front view of another embodiment of the invention.

As best seen in FIGS. 1 and 2*a*, cuff 30 extends along the circumferential bottom of cap 10. Cuff 30 creates a channel 36 along which speaker wires 22 and 24 are lain.

As best seen in FIG. 2*a*, fastener 16 is attached to opposing ends of sleeve 14. Fastener 16 affixes to inside of hat 10 by means of Velcro® adhesion. Although a Velcro adhesion means is preferred for the embodiment described herein, other fastening means could also be utilized, including but not limited to buttons, snaps, adhesive tape, magnets, pins, and cord ties.

Cuff 30 is pressed against the sidewalls of cap 10 by fastener 31. Fastener 31 utilizes Velcro° adhesion, which allows cuff 30 to be separated from sidewall of cap 10 to allow for adjustment or storage inside of hat 10 of speaker wires 22 and 24, and for storage of connector 20 and dual wire 42 when those components are not in use.

The sum of these features and advantages is contained in one another embodiment of the invention (FIG. 2*b*), which allows for an alternate placement of the aforementioned sleeve 14 and audio device 18. In this embodiment, sleeve 14 is aligned down the center axis of cap 10, with the open end of sleeve 14 oriented towards the crown of cap 10 and the closed end oriented towards visor 12. This allows the invention to be worn in a backwards position, which, for stylistic reasons, is the favored position for some users.

Figure 3A:
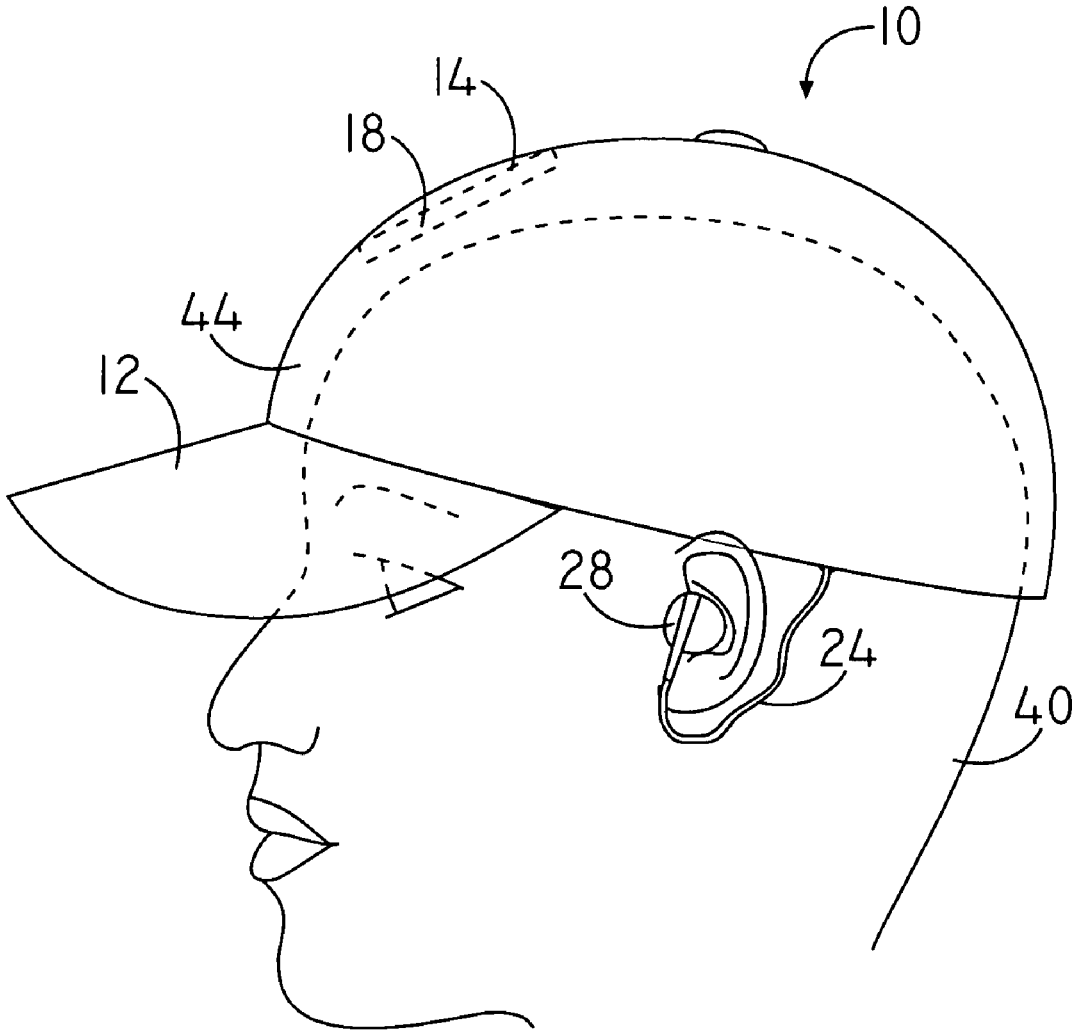
FIG. 3*a* is a cut-away side view of the invention showing the invention worn by a user.

As seen in FIG. 3*a*, sleeve 14 and audio player device 18 occupy a void space 44 that occurs when hat 10 sits upon the head 42 of a user 40.

Figure 3B:
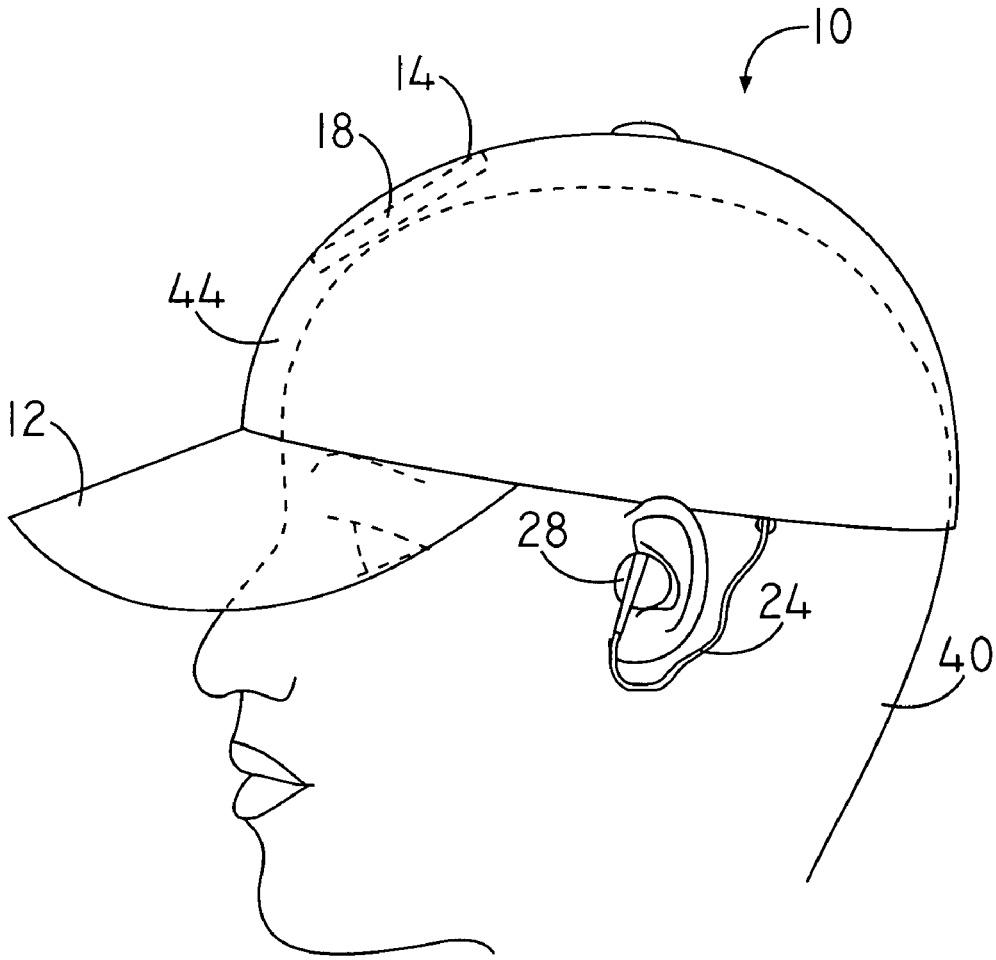
FIG. 3*b* is a cut-away side view of the invention showing the invention worn in an alternate manner by a user.

As seen in FIG. 3*b*, hat 10 can be adjusted on the head of the user 40 into a forward tilted position so as to allow audio device 18 to rest upon, and thereby be supported by, the forehead of user 40. This provides a secure foundation for the audio device 18, as well as the system as a whole, thus allowing the user 40 to comfortably engage in vigorous activities like jogging, biking or other forms of exercise.

As best shown in FIGS. 1 through 3*b*, speaker wires 22 and 24 extend from connector plug 20 in audio device 18 and run along cuff channel 36 through holes 32 and 34 to terminate at respective speakers 26 and 28, which are inserted into the ears of user 40. Holes 32, 34 can be formed by any method known in the art, including riveting with suitable rivet tools.

Figure 4A:
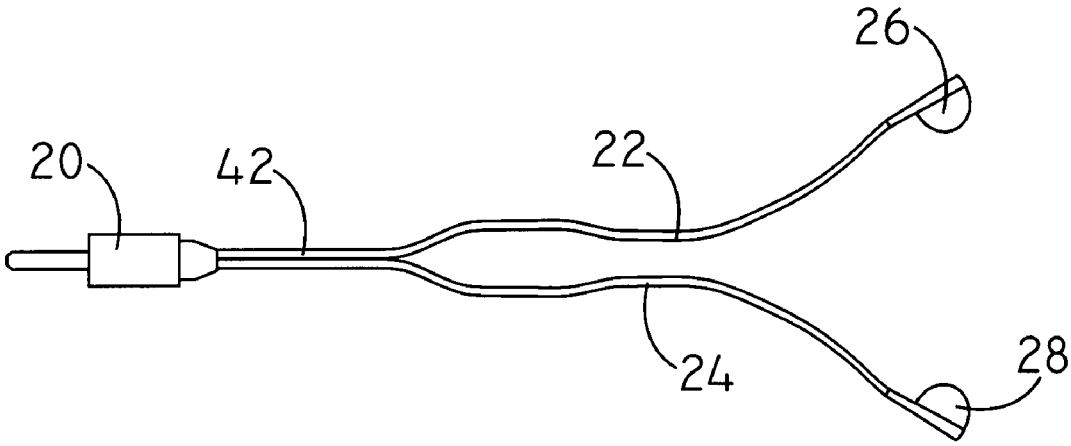
FIG. 4*a* is a top view of an isolated component.

As seen in FIG. 4*a*, dual wire 42 extends from connector 20. Dual wire 42 splits to form speaker wires 22 and 24, which terminate at speakers 26 and 28 respectively.

Figure 4B:
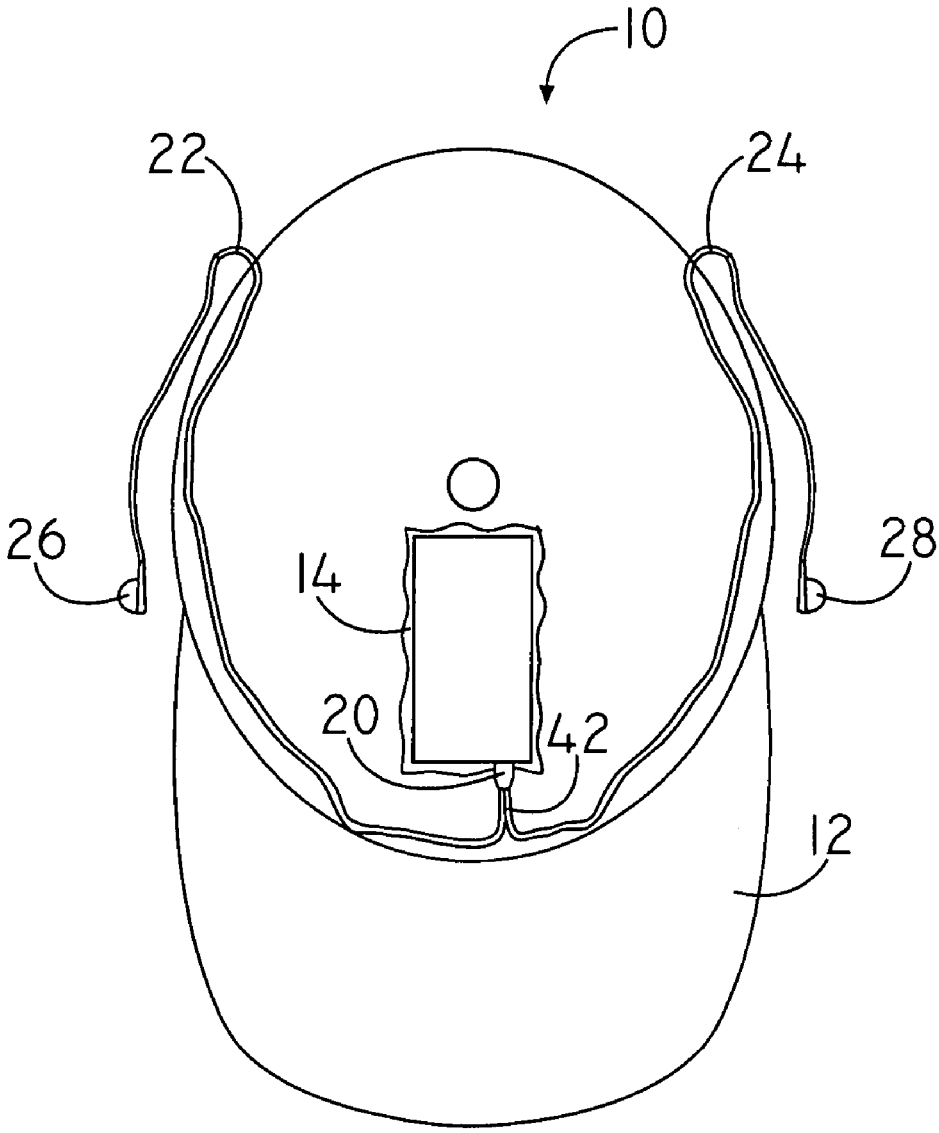
FIG. 4*b* is a top view of the invention showing a diagram of the wire circuitry.

As seen in FIG. 4*b*, dual wire 42 splits a short distance (approximately 2 inches) from connector 20 at audio device 18. Though equal in length, speaker wires 22 and 24 have different passage lengths along cuff channel 36 before exiting respectively through holes 32 and 34. Because speaker wire 24 has only a short passage to exit hole 32, it is shirred to take up the excess wire, with the shirred coils tucked into cuff channel 36. Alternatively, speaker wire 24 may be cut to appropriate length. This allows the invention to be worn more comfortably, and without the encumbrance of dangling excess wires or other components.

As seen in FIGS. 3*a* and 3*b*, speaker wires 22 and 24 (FIG. 1) suspend from hat 10 at a position located to the rear of the user's 40 ears. This location allows the speaker wires 22, 24 to be partially tucked behind the ear lobes of the user 40, thus helping to constrain wires 22, 24 during vigorous activity. Additionally, this location provides stylistic advantages, because it serves to mask the visual impact of the speaker wires 22, 24 to a degree that renders them virtually invisible to all but the most preternaturally curious observers.

When the audio playing system is not in use, audio device 18 may be unplugged from connector 20 and completely removed from sleeve 14. Connector 20 and dual wire 42 may then be tucked into cuff channel 36 for storage until further use. Similarly, speakers 26, 28 and their respective wires 22, 24 may also be tucked into channel 36 for convenient, out of the way storage until further use. In this manner, the invention may perform all the functions of a hat, but without the unsightly adornments associated with electrical wiring and apparatus.

The above advantages and comforts, combined with the discreet and secure containment of the major audio. components when the invention is used for audio play or reception, distinguishes the invention from other known patents. In summary, no other invention allows a hat to perform all the functions of style and utility for which a hat is desired while providing a secure platform for an audio system.

Since other modifications are changes varied to fit particular operating conditions and environments or designs will be apparent to those skilled in the art, the invention is not considered limited to the examples chosen for purposes of disclosure, and covers changes and modifications which do not constitute departures from the true scope of this invention.

Having thus described the invention, what is desired to be protected by Letters Patent is presented in the subsequently appended claims.

What is claimed is:

1. A cap for carrying a portable radio, digital music player, or other miniature device, said cap having a cuff disposed in the inside perimeter thereof, and said cap having a visor connected thereto, said cap comprising:

a) a sleeve disposed in the inner portion of a cap above a visor thereof;

b) two apertures formed in the cuff of said cap;

c) two speaker wires, each having a proximal and a distal end, said proximal ends thereof terminating in a connector plug proximate said sleeve for use with a portable radio, digital music player, or other miniature device, and said distal ends of said speaker wires being disposed in said cuff and extending through said two apertures therein; and d) speakers connected to the distal end of respective speaker wires.

2. The cap in accordance with claim 1, wherein said sleeve is oriented substantially horizontally with respect to the plane of said visor.

3. The cap in accordance with claim 1, wherein said sleeve is oriented substantially vertically with respect to the plane of said visor.

4. The cap in accordance with claim 1, wherein said sleeve comprises material selected from the group: elasticized fabric, cotton, wool, synthetic blend, nylon, fleece, corduroy, and denim.

5. The cap in accordance with claim 1, wherein said apertures comprise rivets.

6. The cap in accordance with claim 1, wherein said sleeve is detachable.

7. The cap in accordance with claim 1, wherein said sleeve is attached to said inner portion of said cap by at least one of the group: Velcro° fasteners, pins, buttons, adhesive tape, magnets, snaps, and cord ties.

8. The cap in accordance with claim 1, wherein said sleeve has one opening for receiving a portable, miniature radio or music player.

9. The cap in accordance with claim 1, wherein said speakers comprise at least one from the group: earphones and buds.

10. The cap in accordance with claim 1, wherein said two speaker wires are each cut to a predetermined length.

11. A combination cap and portable radio, digital music player, or other miniature device, said cap having a cuff disposed in the inside perimeter thereof, and said cap having a visor connected thereto, said cap comprising:

a) a sleeve disposed in the inner portion of a cap above a visor thereof;

b) a portable radio, music player or other miniature device disposed in said sleeve;

c) two apertures formed in the cuff of said cap;

d) two speaker wires, each having a proximal and a distal end, said proximal ends thereof terminating in a connector plug proximate said sleeve, and said distal ends of said speaker wires being disposed in said cuff and extending through said two apertures therein; and e) speakers connected to the distal end of respective speaker wires.

12. The combination cap and portable radio, digital music player, or other miniature device in accordance with claim 11, wherein said sleeve is oriented substantially horizontally with respect to the plane of said visor.

13. The combination cap and portable radio, digital music player, or other miniature device in accordance with claim 11, wherein said sleeve is oriented substantially vertically with respect to the plane of said visor.

14. The combination cap and portable radio, digital music player, or other miniature device in accordance with claim 11, wherein said sleeve comprises material selected from the group: elasticized fabric, cotton, wool, synthetic blend, nylon, fleece, corduroy, and denim.

15. The combination cap and portable radio, digital music player, or other miniature device in accordance with claim 11, wherein said apertures comprise rivets.

16. The combination cap and portable radio, digital music player, or other miniature device in accordance with claim 11, wherein said sleeve is detachable.

17. The combination cap and portable radio, digital music player, or other miniature device in accordance with claim 11, wherein said sleeve is attached to said inner portion of said cap by at least one of the group: Velcro® fasteners, pins, buttons, adhesive tape, magnets, snaps, and cord ties.

18. The combination cap and portable radio, digital music player, or other miniature device in accordance with claim 11, wherein said sleeve has one opening for receiving said portable, miniature radio or music player.

19. The combination cap and portable radio, digital music player, or other miniature device in accordance with claim 11, wherein said speakers comprise at least one from the group: earphones and buds.

20. The combination cap and portable radio, digital music player, or other miniature device in accordance with claim 11, wherein said two speaker wires are each cut to a predetermined length.

* * * * *